US009485558B2

(12) United States Patent
Balbach

(10) Patent No.: US 9,485,558 B2
(45) Date of Patent: Nov. 1, 2016

(54) FLYING DISC WITH SPEAKER

(71) Applicant: Grant Alan Balbach, Fishers, IN (US)

(72) Inventor: Grant Alan Balbach, Fishers, IN (US)

(73) Assignee: Grant A. Balbach, Fishers, IN (US)

( * ) Notice: Subject to any disclaimer, the term of this patent is extended or adjusted under 35 U.S.C. 154(b) by 37 days.

(21) Appl. No.: 14/155,040

(22) Filed: Jan. 14, 2014

(65) Prior Publication Data

US 2015/0201262 A1 Jul. 16, 2015

(51) Int. Cl.
*H04R 1/02* (2006.01)

(52) U.S. Cl.
CPC ..... *H04R 1/028* (2013.01)

(58) Field of Classification Search
CPC .. H04R 1/028; H04R 2499/10; A63H 33/18; A63H 33/22; A63H 33/26; A63H 27/12
USPC ..... 446/34, 46–47
See application file for complete search history.

(56) References Cited

U.S. PATENT DOCUMENTS

| | | | | |
|---|---|---|---|---|
| 5,895,308 | A * | 4/1999 | Spector | 446/397 |
| 2006/0183576 | A1* | 8/2006 | Lindsey et al. | 473/570 |
| 2010/0020978 | A1* | 1/2010 | Garudadri | H04R 5/04 381/57 |
| 2011/0053716 | A1* | 3/2011 | Lewis | 473/570 |
| 2013/0303314 | A1* | 11/2013 | Tackett | 473/571 |

* cited by examiner

*Primary Examiner* — Ahmad F. Matar
*Assistant Examiner* — Sabrina Diaz
(74) *Attorney, Agent, or Firm* — Indiano & McConnell LLC

(57) ABSTRACT

A flying disc is disclosed that can be used in recreational activities. The flying disc includes a body having an aerodynamic design. A sound reproduction device housing is attached to the body. A sound reproduction device is positioned in the sound reproduction device housing that is configured to generate audible music via an audio transducer when the sound reproduction device is activated.

5 Claims, 2 Drawing Sheets

FLYING DISC WITH SPEAKER

BACKGROUND

Flying discs have been around for years and are used at gatherings, beeches, and just for fun at various locations. Users of flying discs often like to listen to music while throwing the discs. As such, a need exists for a flying disc that is capable of playing music while being used or while not being used.

DESCRIPTION OF ILLUSTRATIVE EMBODIMENTS

Figure 1:
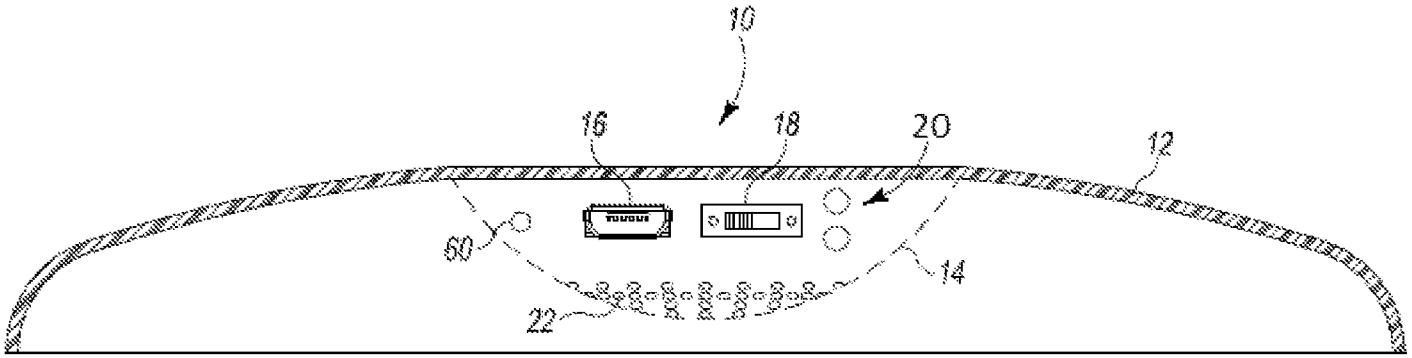
FIG. 1 is a cutaway view of a flying disc.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

Referring to FIG. 1, a flying disc 10 is illustrated that may be used for recreational activities. The flying disc 10 has a generally circular shaped body 12. One illustrative form of popular flying discs are manufactured under the Frisbee® trademark. In other forms, the body 12 could take other shapes and configurations that are aerodynamic. The body 12 may be made from plastic, rubber, foam or any other lightweight material. Positioned within an interior portion of the body 12 is a sound reproduction device housing 14. In the representative form, the sound reproduction device housing 14 is positioned in a central portion of the body 12 but other positions could be used in other forms. In one form, the sound reproduction device housing 14 is formed as an integral part of the flying disc 10, but in other forms it may be removably attached to the flying disc 10.

The sound reproduction device housing 14 includes an input port 16, a switch 18, a volume control 20, and a plurality of apertures 22. In one form, the input port 16 comprises a micro-USB receptacle, but other types of input ports could be used as well. The input port 16 can be used to charge a rechargeable battery and upload music files to memory. The switch 18 is used to turn the flying disc 10 on and off. The volume control 20 is used to control the volume of the flying disc during operation. The apertures 22 allow sound produced by a speaker to be emitted from the sound reproduction device housing 14. In one form, the apertures 22 comprises screen covered apertures or filtered covered apertures. This prevents unwanted objects such as dirt or sand and/or water from entering the sound reproduction device housing 14 and damaging the electronic components contained therein.

Figure 2:
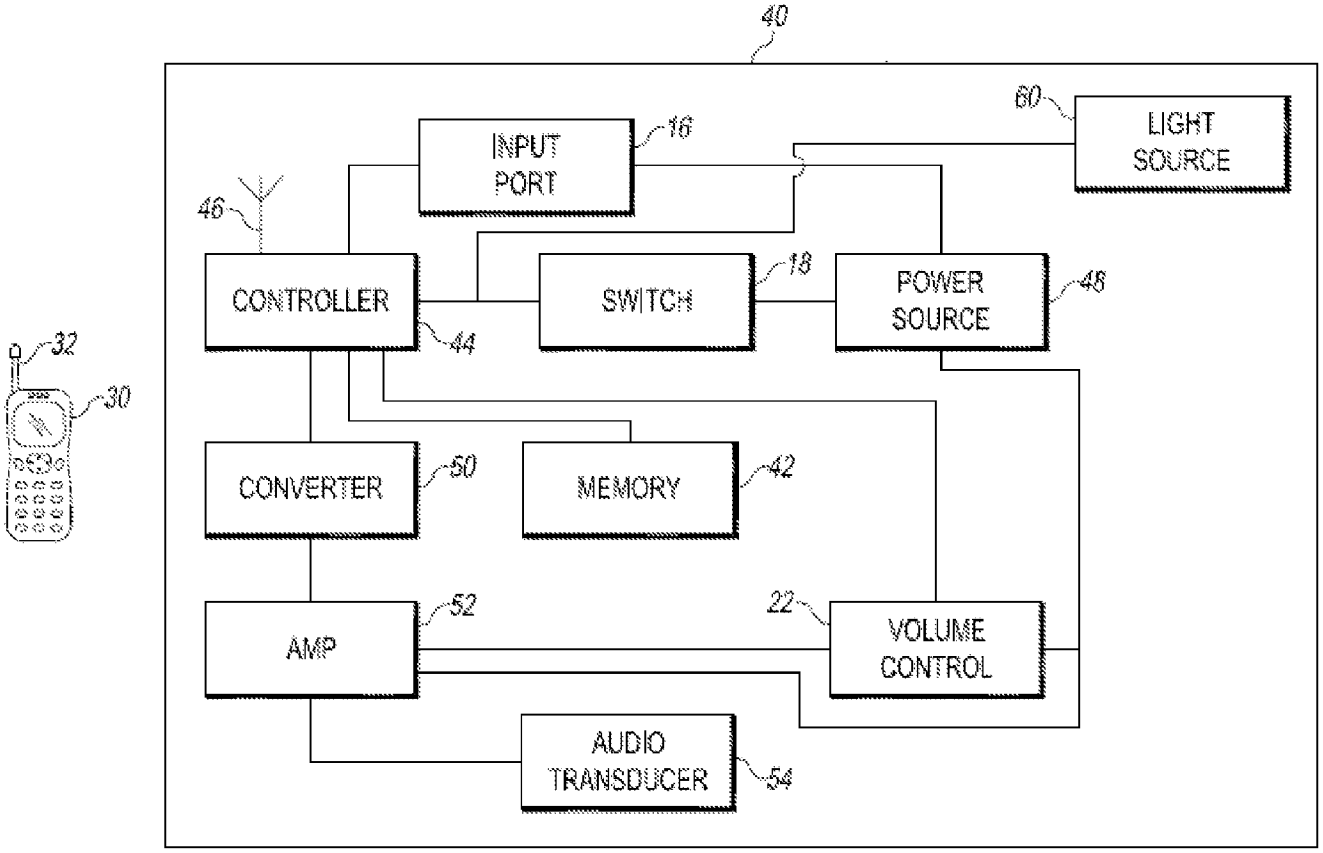
FIG. 2 is a block diagram of the electronic component packaged contained in the flying disc illustrated in FIG. 1.

Referring to FIG. 2, a sound reproduction device 40 that is housed in the sound reproduction device housing 14 is illustrated. A communication device 30 such as an appliance, computer, mobile phone, audio players (such as Ipod®, or MP3 players) is illustrated. Communication device 30 includes a local area transceiver such as a transceiver compliant with the Bluetooth protocol, allowing device 30 to transmit and/or receive signals with another compliant unit via an antenna 32. Bluetooth is a wireless technology standard for exchanging data over short ranges from fixed and mobile devices, creating personal area networks. Bluetooth operates in the range of 2400-2483.5 MHz and is a packet based protocol with a master-slave structure. It allows two devices to be linked to each other and once linked together, they are able to communicate with each other, either in a one way or two way communication manner. Although the Bluetooth protocol is the preferred communication protocol used in the present invention, it is envisioned that other communication protocols may be used in other forms.

The flying disc 10 includes a sound reproduction device 40 that is configured and operable to reproduce audio signals received from device 30 or that are stored in a memory unit 42. The sound reproduction device 40 includes a controller 44 that is connected with a receiver or transceiver 46. The controller 44 could be a microprocessor, digital signal processor, or a specialized chip. The controller 44 is connected with a power source 48 through the switch 18. The switch 18 is used to turn the flying disc 10 on and off.

Once the flying disc 10 is powered on, the controller 44 is operable to pair up with or sync with device 30 so that the device 30 can transmit audio signals to the flying disc 10. The controller 44 can then receive radio transmissions from the device 30 in the form of music files (e.g.—mp3 files, way files, ALAC files, AIFF files, and so on). In that regard, the controller 44 uses the transceiver 46 to establish a communication link or session with between the flying disc 10 and the device 30. In one form, the controller 44 may be connected with a converter 50. The converter 50 may comprise a digital-to-analog converter that is operable to convert digital output signals from the controller 44 into analog signals. In one form, the converter 50 is connected with an amplifier 52. The amplifier 52 is operable to amplify the analog output signal from the converter 50. The amplifier 52 is connected with an audio transducer 54 that is operable to generate audible sounds in response to the output signal from the amplifier 52. In the present invention, the audio signals sent by device 30 comprise music that is audibly reproduced and played by the flying disc 10. As such, the flying disc 10 is configured and operable to play music to users while using the flying disc or while it is not being used.

In another representative form, the controller 44 is operable to receive and store music files in the memory unit 42. In this form, the music or audio files can be uploaded and stored by the flying disc 10 in one of two ways. The first way in which music files can be uploaded is wirelessly. The second manner in which music files could be uploaded to the flying disc 10 is through input port 16. In this form, once the flying disc is turned on, the controller 10 is operable to begin playing the audio files stored in the memory unit 42 unless or until the flying disc 10 is paired up with device 30 at which point music from device 30 would be played. It should be appreciated that in some forms the memory unit 42 may be an integral part of the controller 44.

The power source 48 is used to power the sound reproduction electronic package 40. In one form, the power source 48 comprises a rechargeable battery. As such, the power source 48 may be connected with the input port 16 which is then used to charge the rechargeable battery. The power source 48 may also be connected with the amplifier 48 to provide power to the amplifier 48. In another form, the volume control 22 may be connected with the power source 48 and the amplifier 52. The volume control 22 is used to control the volume of the music being played by the audio transducer 54. In one form, this is accomplished by adjusting the voltage supplied to the amplifier 52. In another form, the volume control 22 may be connected with the controller 44 and the controller 44 may be used to control the volume. In this form, the audio output signals generated by the controller 44 may be in an analog form and there may be no need for the converter 50 or amplifier 52.

In another form, the output of the switch 18 could be connected with a light source 60 that is energized when the flying disc 10 is turned on. The light source 60 could be one or more LEDs that are constantly on or that flash on and off while the flying disc 10 is activated. The output of the light source 60 could protrude outwardly through the sound reproduction device housing 20 as illustrated in FIG. 1.

While the invention has been illustrated and described in detail in the drawings and foregoing description, the same is to be considered as illustrative and not restrictive in character, it being understood that only certain exemplary embodiments have been shown and described. Those skilled in the art will appreciate that many modifications are possible in the example embodiments without materially departing from this invention. Accordingly, all such modifications are intended to be included within the scope of this disclosure as defined in the following claims.

In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A flying disc, comprising:

a body having an aerodynamic design;

a sound reproduction device housing attached to said body, wherein one or more apertures are located in the body below the sound reproduction device, wherein said one or more apertures comprise filtered covered apertures that prevent unwanted objects from entering said body;

a sound reproduction device positioned in said sound reproduction device housing configured to generate audible music via an audio transducer when said sound reproduction device is activated, wherein said sound reproduction device includes a controller connected with a transceiver, wherein said controller is operable to pair said controller with an external media device using said transceiver such that said controller is in wireless communication with said external device, wherein said controller is configured to receive one or more audio files from said external device, wherein said controller is configured to automatically and simultaneously play said one or more audio files using said audio transducer as soon as said one or more audio files are received from said external device, wherein said controller is connected with a converter, wherein said converter is operable to convert a digital output signal from said controller to an analog output signal, wherein said converter is connected with an amplifier, wherein said analog output signal from said converter is directed to said amplifier, wherein said amplifier is configured to generate an amplified output signal, wherein said amplifier is connected with said audio transducer, wherein said amplified output signal is directed to said audio transducer, wherein said controller uses Bluetooth protocol to communicate with said external device, wherein said sound reproduction device includes a power source connected with a controller via a switch, wherein said power source comprises a rechargeable battery, and a volume control connected with said amplifier for controlling a volume associated with said audible music.

2. The flying disc of claim 1, further comprising a light source protruding from said sound reproduction device housing for generating a light when said flying disc is activated.

3. A flying disc, comprising:

a body having an aerodynamic design;

a sound reproduction device housing connected with said body, wherein one or more apertures are located in the body below the sound reproduction device, wherein said one or more apertures comprise filtered covered apertures that prevent unwanted objects from entering said body;

a controller positioned in said housing;

a transceiver connected with said controller, wherein said transceiver is operable to sync said controller in wireless communication with an external media device;

an audio transducer connected with said controller;

a power source connected with said controller;

a switch electrically connected between said power source and said controller for allowing a user to turn the flying disc on and off;

a light source connected between said switch and said controller, wherein when said flying disc is in an activated state said light source is operable to generate a light;

wherein said controller is operable to receive audio content transmitted wirelessly by said external media device; and wherein said controller is operable to automatically and simultaneously play said audio content with said audio transducer as said audio content is wirelessly received by said controller from said external media device.

4. The flying disc of claim 3, further comprising an input port electrically connected with said power source, wherein said power source comprises a rechargeable battery and said input port is used to recharge said power source.

5. The flying disc of claim 4, further comprising a memory unit associated with said controller, wherein said input port is connected with said controller, wherein said controller is configured to upload audio files via said input port to said memory unit.

* * * * *